US007411564B2

(12) United States Patent
Thevenot et al.

(10) Patent No.: US 7,411,564 B2
(45) **Date of Patent: *Aug. 12, 2008**

(54) FREQUENCY MULTIBAND ANTENNA WITH PHOTONIC BANDGAP MATERIAL

(75) Inventors: Marc Thevenot, Peyrilhac (FR); Régis Chantalat, Limoges (FR); Bernard Jecko, Rilhac-Rancon (FR); Ludovic Leger, Limoges (FR); Thierry Monediere, Limoges (FR); Patrick Dumon, Vigoulet-Auzil (FR)

(73) Assignees: Centre National de la Recherche Scientifique (C.N.R.S.), Paris (FR); Centre National d'Etudes Spatiles, Paris (FR)

( * ) Notice: Subject to any disclaimer, the term of this patent is extended or adjusted under 35 U.S.C. 154(b) by 183 days.

This patent is subject to a terminal disclaimer.

(21) Appl. No.: 10/532,303

(22) PCT Filed: Oct. 23, 2003

(86) PCT No.: PCT/FR03/03146

§ 371 (c)(1),
(2), (4) Date: Dec. 14, 2005

(87) PCT Pub. No.: WO2004/040695

PCT Pub. Date: May 13, 2004

(65) Prior Publication Data

US 2006/0097917 A1 May 11, 2006

(30) Foreign Application Priority Data

Oct. 24, 2002 (FR) ..... 02 13326
Jul. 31, 2003 (FR) ..... 03 09467

(51) Int. Cl.
*H01Q 15/02* (2006.01)
*H01Q 1/38* (2006.01)

(52) U.S. Cl. ..... 343/909; 343/700 MS

(58) Field of Classification Search ..... 343/700 MS, 343/756, 840, 909
See application file for complete search history.

(56) References Cited

U.S. PATENT DOCUMENTS

| | | | | |
|---|---|---|---|---|
| 4,236,161 | A | 11/1980 | Omh | 343/781 CA |
| 6,262,830 | B1 | 7/2001 | Scalora | 359/248 |
| 6,954,177 | B2 * | 10/2005 | Channabasappa et al. | 343/700 MS |
| 6,975,269 | B2 * | 12/2005 | Jecko et al. | 343/700 MS |
| 7,233,299 | B2 * | 6/2007 | Thevenot et al. | 343/912 |
| 7,242,368 | B2 * | 7/2007 | Thevenot et al. | 343/909 |

FOREIGN PATENT DOCUMENTS

FR 2 801 428 5/2001

OTHER PUBLICATIONS

Chung K B et al:, "Defect modes in a two-dimensional square-latice photonic crystal", Optics Communications, North-Holland Publishing Co. Amsterdam, NL, vol. 209, No. 4-6, 15 aout 2002 (Aug. 15, 2002), pp. 229-235, XP004375303, ISSN: 0030-4018 le document en entier.

(Continued)

*Primary Examiner*—Shih-Chao Chen
(74) *Attorney, Agent, or Firm*—Young & Thompson

(57) ABSTRACT

A frequency multiband antenna includes a photonic bandgap material having at least one band gap, one single periodicity defect of the bandgap material so as to produce several narrow bandwidths within the at least one band gap of the bandgap material, and an excitation device capable of transmitting and/or receiving electromagnetic waves within the narrow bandwidths.

12 Claims, 5 Drawing Sheets

OTHER PUBLICATIONS

Thevenot M et al:, "Directive Photonic-Bandgap Antennas", IEEE Transactions on Microwave Theory and Techniques, IEEE Inc. New York, US, vol. 47, No. 11, novembre 1999 (Nov. 1999), pp. 2115-2121, PX0865109, ISSN: 0018-9480, figures 10, 11.

Shi B et al:, "Defective Photonic Crystals With Greatly Enhanced Second-Harmonic Generation", Optics Letters, Optical Society of America, Washington, US, vol. 26, No. 15, 1 aout 2001 (Aug. 1, 2001), pp. 1194-1196, XP001110592, ISSN: 0146-9592, le document en entier.

* cited by examiner

FREQUENCY MULTIBAND ANTENNA WITH PHOTONIC BANDGAP MATERIAL

FIELD OF THE INVENTION

The invention relates to a frequency multiband antenna comprising:

a PBG material (Photonic Bandgap) suitable for the spatial and frequency-wise filtering of electromagnetic waves, this PBG material exhibiting at least one stopband and forming an exterior surface radiating in emission and/or in reception, at least one defect of periodicity of the PBG material in such a way as to create at least one narrow passband within said at least one stopband of this PBG material, and an excitation device suitable for emitting and/or receiving electromagnetic waves inside said at least one narrow passband created by said at least one defect.

BACKGROUND OF THE INVENTION

PBG material antennas have the advantage of exhibiting a reduced footprint with respect to other types of antennas, such as reflector-type, lens-type or horn-type antennas.

Such PBG material antennas are described in particular in patent application FR 99 14521, published under No. 2 801 428 in the name of C.N.R.S. (Centre National de la Recherche Scientifique). This patent describes precisely an embodiment of a PBG material exhibiting a single defect forming a leaky resonant cavity. Moreover, and although no embodiment of this variant is described explicitly, this patent also envisages the possibility of creating multiband antennas from PBG materials. Specifically, this patent teaches that a defect created in the PBG material makes it possible to produce a narrow passband within a wider stopband of this PBG material. Consequently, to create multiband antennas, several defects must be created in the PBG material so as to create several narrow passbands within the same stopband of the PBG material. This is what is indicated on page 10, lines 23 to 25 of this patent application FR 99 14521.

It is recalled here that a multiband antenna refers to an antenna suitable for working at several different, mutually distinct working frequencies. Moreover, the multiband antenna exhibits, for each of the working frequencies, the same radiation pattern and the same radiation polarization.

The construction of multiband antennas according to the teaching of patent application FR 99 14521 has turned out to be complicated, on account in particular of the difficulties of design of a multidefect PBG material.

The invention aims to remedy this drawback by proposing a frequency multiband antenna made of a PBG material which is simpler to construct.

SUMMARY OF THE INVENTION

A subject of the invention is therefore also a frequency multiband antenna such as described hereinabove, characterized in that:

the excitation device is suitable for working simultaneously at least around a first and a second distinct working frequency;

the first and the second working frequencies are situated inside respectively a first and a second narrow passband, mutually distinct, and the first and the second narrow passbands are created by the same defect of periodicity of the PBG material.

Specifically, it has been discovered that one and the same single defect of the PBG material creates several narrow passbands centered respectively about several mutually differing frequencies. Thus, to construct a frequency multiband antenna, it is not necessary to construct a multidefect PBG material antenna, thereby simplifying the construction of such antennas.

According to one of the characteristics of a frequency multiband antenna in accordance with the invention:

the periodicity defect of the PBG material creating the first and the second narrow passbands forms a leaky resonant cavity exhibiting a constant height in a direction orthogonal to said exterior radiating surface, and this height is adapted so as to place the first and the second narrow passbands within said at least one stopband of the PBG material, the height of the cavity is adapted so as to place the first and the second narrow passbands within one and the same stopband of the PBG material, the PBG material exhibits a first and a second mutually spaced disjoint stopband, and the height of the cavity is adapted so as to place the first and the second narrow passbands within respectively the first and the second stopbands of the PBG material, said first narrow passband is substantially centered on a fundamental frequency, while said second narrow passband is substantially centered on an integer multiple of this fundamental frequency, the cavity exhibits a family of resonant frequencies formed by a fundamental frequency and its harmonics, the resonant mode of the cavity and the radiation pattern of the antenna being the same for each resonant frequency of the family, and the first and the second working frequencies each correspond, in their respective narrow passband, to a frequency of the same family, the cavity exhibits at least two families of resonant frequencies each formed by a fundamental frequency and its harmonics, the resonant mode and the radiation pattern of the antenna being the same for each resonant frequency of one and the same family and different from those of the other families of resonant frequencies, and the first and the second working frequencies each correspond, in their respective narrow passband, to frequencies belonging to different families, the excitation device is able to emit electromagnetic waves at the first working frequency having a different polarization from the electromagnetic waves emitted at the second working frequency, the excitation device comprises at least one same excitation element suitable for emitting and/or for receiving electromagnetic waves simultaneously at the first and at the second working frequencies, the excitation device comprises a first and a second excitation element each suitable for emitting and/or for receiving electromagnetic waves, and the first excitation element is suitable for working at the first working frequency, while the second excitation element is suitable for working at the second working frequency, each of the excitation elements is able to generate, on said exterior surface, respectively a first and a second mutually disjoint radiating spot, each of these radiating spots representing the origin of an electromagnetic wave beam radiated in emission and/or in reception by the antenna, the leaky resonant cavity is of parallelepipedal shape.

BRIEF DESCRIPTION OF THE DRAWINGS

The invention will be better understood on reading the description which follows, given merely by way of example, and whilst referring to the drawings, in which.

DETAILED DESCRIPTION OF THE PREFERRED EMBODIMENTS

Figure 1:
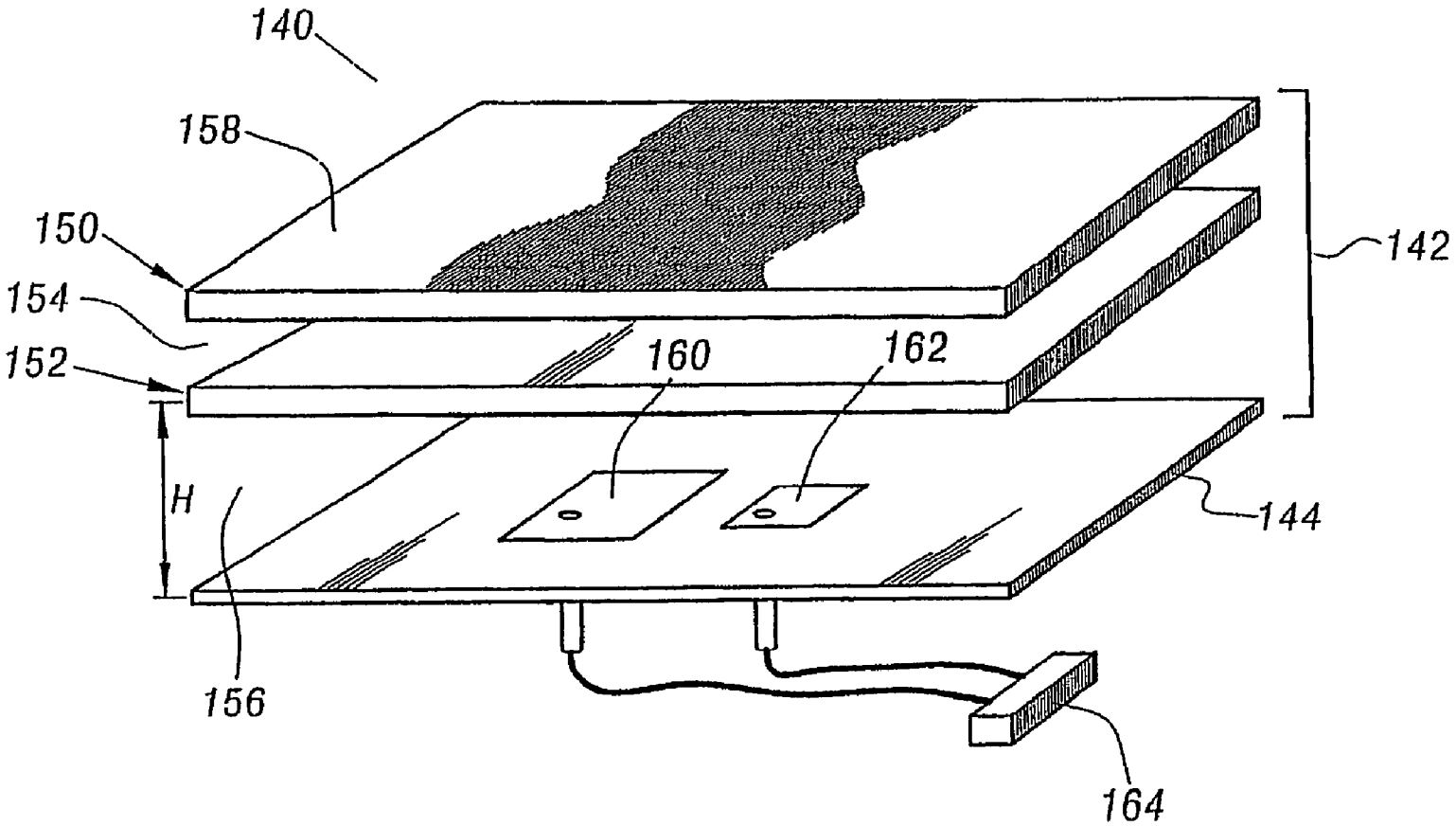
FIG. 1 is an illustration of a frequency multiband antenna in accordance with the invention.

FIG. 1 represents a frequency multiband antenna 140 comprising a photonic bandgap material 142 or PBG material and an electromagnetic wave reflector metallic plane 144.

It is recalled that a PBG material is a material which possesses the property of absorbing certain frequency ranges, so that it exhibits one or more stopbands, in which any transmission of electromagnetic waves is prohibited.

The PBG material generally consists of a periodic array of dielectric of variable permittivity and/or permeability.

The introduction of a break into this geometric and/or radioelectric periodicity, which break is also referred to as a defect, makes it possible to produce an absorption defect and hence to create a narrow passband within a stopband of the PBG material. The PBG material is, under these conditions, referred to as a defect PBG material.

For a detailed description of such an antenna exhibiting a single defect, the reader may usefully refer to French patent application FR 99 14521 (2 801 428), and more particularly to the embodiment described with regard to FIG. 6.

The general arrangement of the antenna 140 already having been described in detail in the above referenced patent application, only the characteristics specific to this antenna 140 will be described here in detail.

Figure 2:
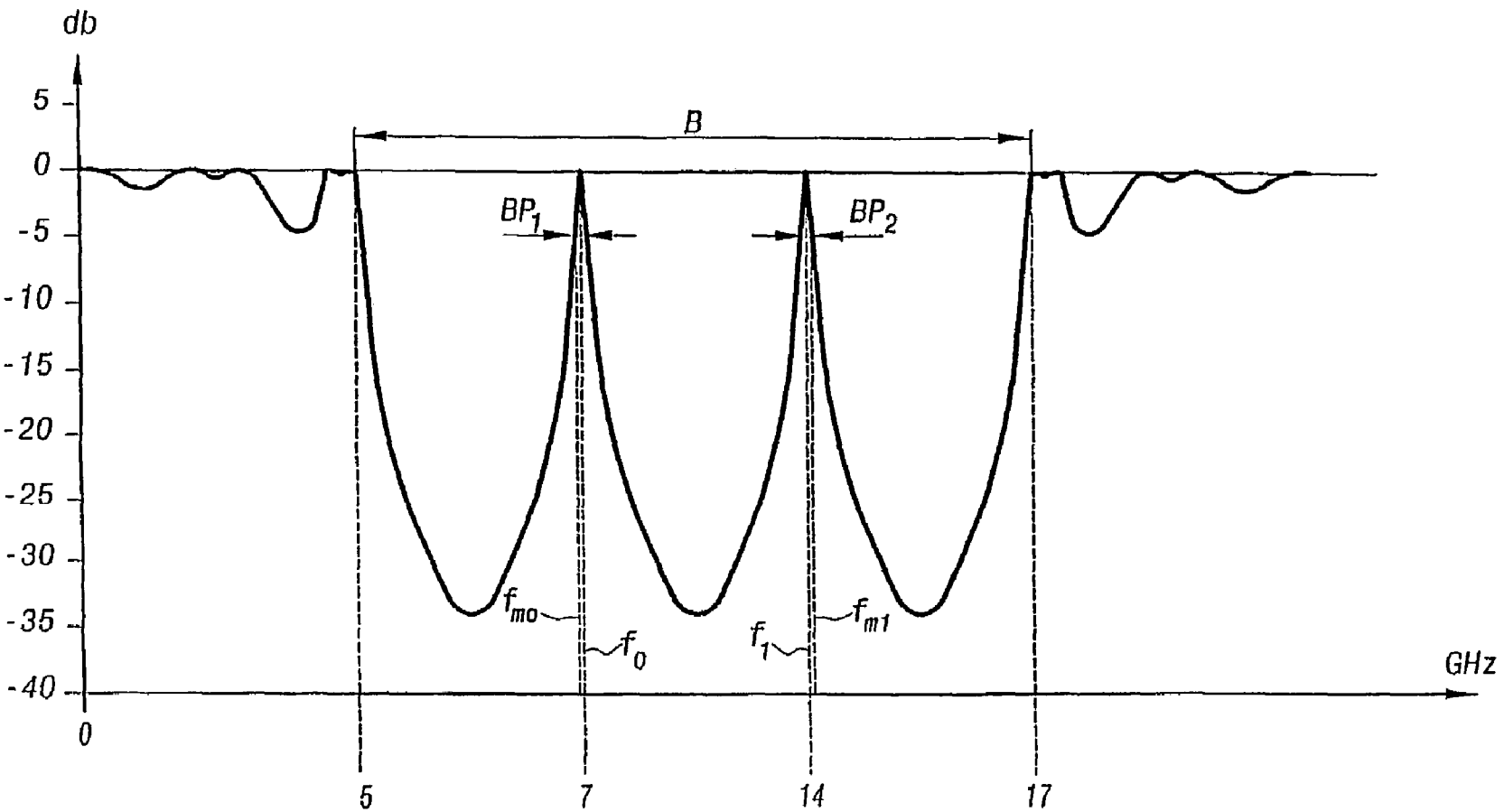
FIG. 2 is a graphic representing the transmission coefficient of the antenna of FIG. 1.

The PBG material 142 is chosen here to exhibit the widest possible stopband B. This stopband B is illustrated in the graphic of FIG. 2 representing the profile of the transmission coefficient in decibels of the defect PBG material 142 as a function of the frequency of the electromagnetic waves. This transmission coefficient represents the ratio of the quantity of electromagnetic energy emitted to the quantity of electromagnetic energy received. The stopband B of the PBG material here extends from 5 GHz to 17 GHz.

The PBG material 142 comprises a stack of flat dielectric sheets, along a direction perpendicular to the reflector plane 144. This stack is composed here, for example, of two sheets 150, 152 made of a first dielectric material such as, for example, alumina, and of two sheets 154 and 156 made of a different dielectric material such as, for example, air. The sheet 154 is interposed between the sheets 150 and 152, while the sheet 156 is interposed between the sheet 152 and the reflector plane 144. The sheet 150 is placed at the opposite end of the stack from the reflector plane 144 and exhibits an interior surface in contact with the sheet 154 and an exterior surface 158 opposite to the interior surface. The exterior surface 158 forms a radiating surface of the antenna in emission and/or in reception.

The sheets 150 to 156 are parallel to the reflector plane 144.

The height of the sheet 156 is greater than the height of the sheet 154 and therefore forms a single-break of the geometric periodicity of the stack of dielectric materials of the PBG material. The PBG material 142 therefore exhibits, in this embodiment, one single defect. The sheet 156 here forms a leaky parallelepipedal resonant cavity of constant height H in a direction perpendicular to the reflector plane 144.

The cavity 156 creates a narrow passband $BP_1$ (FIG. 2) centered around a fundamental frequency $f_0$. The height H determines the frequency $f_0$ and therefore the position of the narrow passband $BP_1$ within the stopband B. Here, $f_0$ is substantially equal to 7 GHz.

It has been noted that this same defect or cavity 156 also generates other narrow passbands substantially centered on integer multiples of the frequency $f_0$. Hitherto, these other narrow passbands had not been observed, since they were situated outside the stopband B. Specifically, in the known antennas of this type, the stopband is not wide enough and the frequency $f_0$ is placed substantially in the middle of the stopband.

In this embodiment, the height H is therefore chosen so that the passband $BP_1$ is sufficiently off-centered in such a way that a passband $BP_2$ (FIG. 2), centered on a frequency $f_1$ substantially equal to twice $f_0$, is also placed inside the same stopband B. Here, $f_1$ is substantially equal to 14 GHz.

In a known manner, a parallelepipedal resonant cavity such as this exhibits several families of resonant frequencies. Each family of resonant frequencies is formed by a fundamental frequency and its harmonics or integer multiples of the fundamental frequency. Each resonant frequency of one and the same family excites the same resonant mode of the cavity. These resonant modes are known by the terms resonant modes $TM_0$, $TM_1$, . . . , $TM_i$. These resonant modes are described in greater detail in the document by F. Cardiol, "Electromagnétisme, traitéd'Electricité, d'Electronique et d'Electrotechnique", Ed. Dunod, 1987. Each resonant mode $TM_i$ is able to be excited or activated by an electromagnetic wave close to a fundamental frequency $f_{mi}$. These frequencies $f_{mi}$ or their harmonics are present in each of the narrow passbands $BP_1$ and $BP_2$.

Each resonant mode corresponds to a particular radiating pattern or shape of radiation of the antenna 140.

Figure 3A:
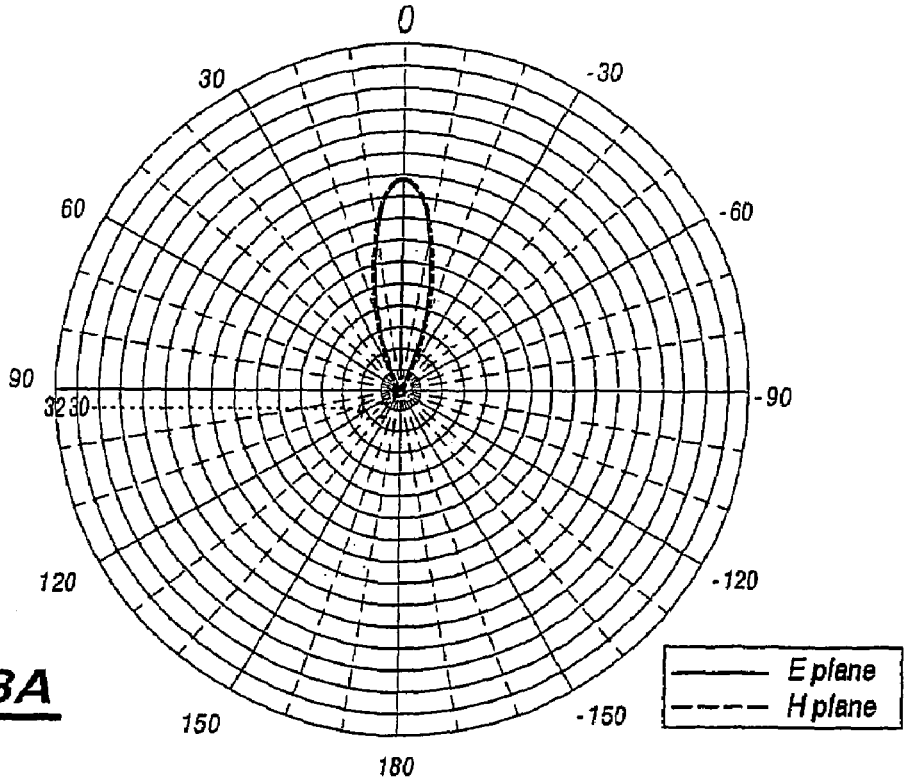
FIGS. 3A and 3B are illustrations of the radiation patterns of the antenna of FIG. 1.
Figure 3B:
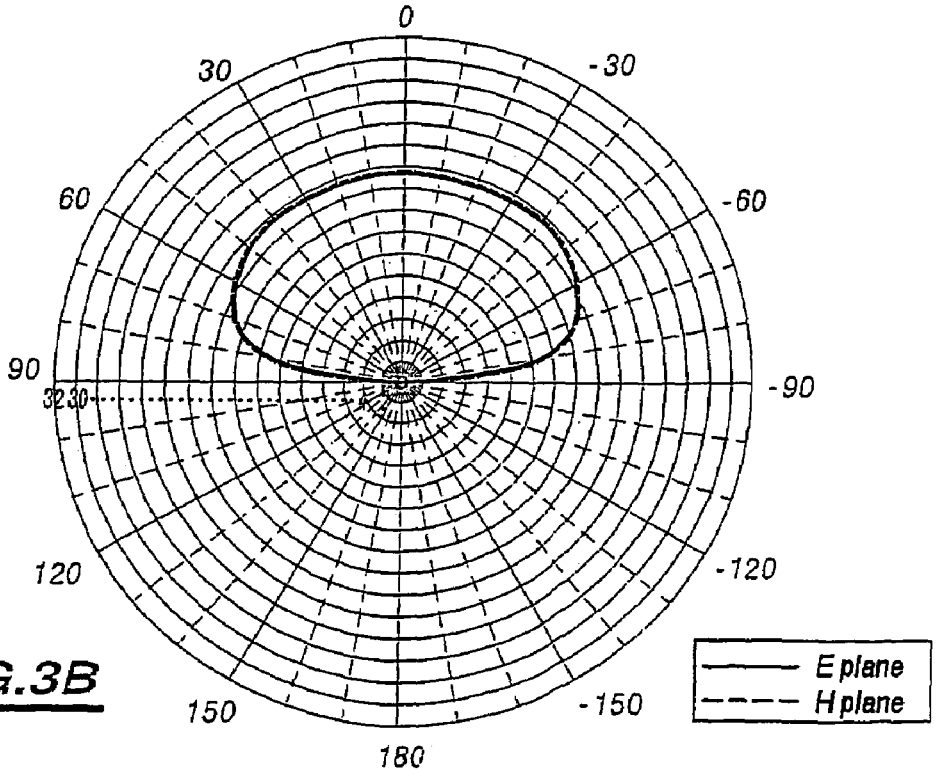

By way of example, FIGS. 3A and 3B each represent a radiation pattern or radiation shape corresponding respectively to the resonant modes $TM_0$ and $TM_1$.

Here, the characteristics of the sheets in the direction perpendicular to the reflector plane, that is to say, in particular, their height or respective thickness, is determined in accordance with the teaching of patent application FR 99 14521. More precisely, these characteristics are determined so that the resonant mode $TM_0$ corresponds to a directional radiation along the favored direction of emission and/or of reception perpendicular to the exterior surface 158. Here, this directional radiation is represented in FIG. 3A by an elongate main lobe along the direction perpendicular to the surface 158. It has been noted that the shape of the radiation represented in FIG. 3A does not depend on the lateral dimensions of the cavity 156, that is to say the dimensions of this cavity in a plane parallel to the reflector plane if these lateral dimensions are greater than $\phi$, $\phi$ being given by the following formula:

$$G_{dB} \geq 20\log\frac{\pi\Phi}{\lambda} - 2.5. \quad (1)$$

where:

$G_{dB}$ is the gain in decibels desired for the antenna, $\Phi=2R$, $\lambda$ is the wavelength corresponding to the median frequency $f_0$.

By way of example, for a gain of 20 dB, the radius R is substantially equal to 2.15 λ.

On the other hand, the shape of the radiation corresponding to resonant modes higher than the resonant mode $TM_0$ varies as a function of the lateral dimensions of the cavity 156. Here, these lateral dimensions are determined in such a way that the resonant mode $TM_1$ corresponds to a radiation pattern that is substantially omnidirectional in a three-dimensional half-space delimited by the plane passing through the reflector plane 144.

The dimensions of the antenna 140 making it possible to obtain the desired radiation shapes are determined, for example, by experimentation.

Advantageously, these experimentations consist, with the aid of software for simulating the antenna 140, in determining the radiation shapes corresponding to given dimensions, and then in varying these dimensions until the desired radiation patterns are obtained.

Finally, the antenna 140 comprises, here, two excitation elements 160 and 162 disposed side by side on the surface of the plane 144 inside the cavity 156. These excitation elements 160 and 162 are able to emit and/or receive an electromagnetic wave respectively at the frequencies $f_{T1}$ and $f_{T2}$. The frequency $f_{T1}$ is close to the frequency $f_{m0}$ or to one of its harmonics. It is situated inside the narrow passband $BP_1$ so as to excite the resonant mode $TM_0$ of the cavity 156. The frequency $f_{T2}$ is close to the frequency $f_{m1}$ or to one of its harmonics. It is placed inside the passband $BP_2$ so as to excite the resonant mode $TM_1$.

These excitation elements are known per se. They are, for example, patch or plate antennas, dipoles or slot antennas able to transform electrical signals into electromagnetic waves. For this purpose, the excitation elements 160 and 162 are linked to a generator/receiver 164 of conventional electrical signals.

The manner of operation of the frequency multiband antenna described with regard to FIG. 1 will now be described.

In emission, the generator/receiver 164 transmits electrical signals to one or simultaneously to both of the excitation elements 160 and 162. These electrical signals are converted by the element 160 into an electromagnetic wave of frequency $f_{T1}$ and by the element 162 into an electromagnetic wave of frequency $f_{T2}$. These electromagnetic waves at the frequencies $f_{T1}$ and $f_{T2}$ do not interfere with one another, since the frequencies $f_{T1}$ and $f_{T2}$ are very different. Specifically, here, the frequencies $f_{T1}$ and $f_{T2}$ are each situated in a narrow passband, spaced apart by a range of absorbed frequencies of width of the order of 7 GHz. Moreover, these working frequencies $f_{T1}$ and $f_{T2}$ each being situated inside a narrow passband inside the stopband B, they are not absorbed by the PBG material 142.

The electromagnetic wave of frequency $f_{T1}$ excites the resonant mode $TM_0$ of the cavity 156, this giving rise to a radiation of the antenna 140 which is directional for this frequency and to the appearance of a radiating spot in emission and/or in reception formed on the surface 158. The radiating spot is here the zone of the exterior surface containing all of the points where the power radiated in emission and/or in reception is greater than or equal to half the maximum power radiated from this exterior surface by the antenna 4. Each radiating spot admits a geometrical center corresponding to the point where the radiated power is substantially equal to the maximum radiated power.

In the case of the resonant mode $TM_0$, this radiating spot is inscribed within a circle whose diameter $\phi$ is given by formula (1).

The electromagnetic wave of frequency $f_{T2}$ excites, for its part, the resonant mode $TM_1$, this giving rise to an omnidirectional radiation in a half-space at this frequency $f_2$ and to the appearance of a second radiating spot in emission and/or in reception formed on the surface 158.

Each radiating spot corresponds to the base or cross section at the origin of a radiated beam of electromagnetic waves.

For an appropriate distance separating the elements 160, 162, the radiating spots are disjoint.

In reception only the electromagnetic waves received by the exterior surface 158 and having a frequency lying either in the passband $BP_1$, or in the passband $BP_2$, propagate as far as the cavity 156.

Given the directivity of the radiation pattern of the antenna 140 for the frequency $f_{T1}$, only the electromagnetic waves at the frequency $f_{T1}$ and substantially perpendicular to the exterior surface 158 are transmitted as far as the excitation element 160. Conversely, given that, for the frequency $f_{T2}$, the antenna 140 is practically omnidirectional in a half-space, the direction of reception of the electromagnetic waves at the frequency $f_{T2}$ on the exterior surface is practically arbitrary.

Inside the cavity 156, the excitation element 160 transforms the electromagnetic waves at the frequency $f_{T1}$ into electrical signals transmitted to the generator/receiver 164. The excitation element 162 acts in an identical manner in respect of the electromagnetic waves at the frequency $f_{T2}$.

Thus, the antenna 140 exhibits the characteristics of a multifunction antenna, that is to say of being suitable for operating at two different frequencies and of having, for each working frequency, a particular radiation pattern. Here, the antenna 140 is directional for the working frequency $f_{T1}$ and omnidirectional in a half-space for the frequency $f_{T2}$.

Figure 4:
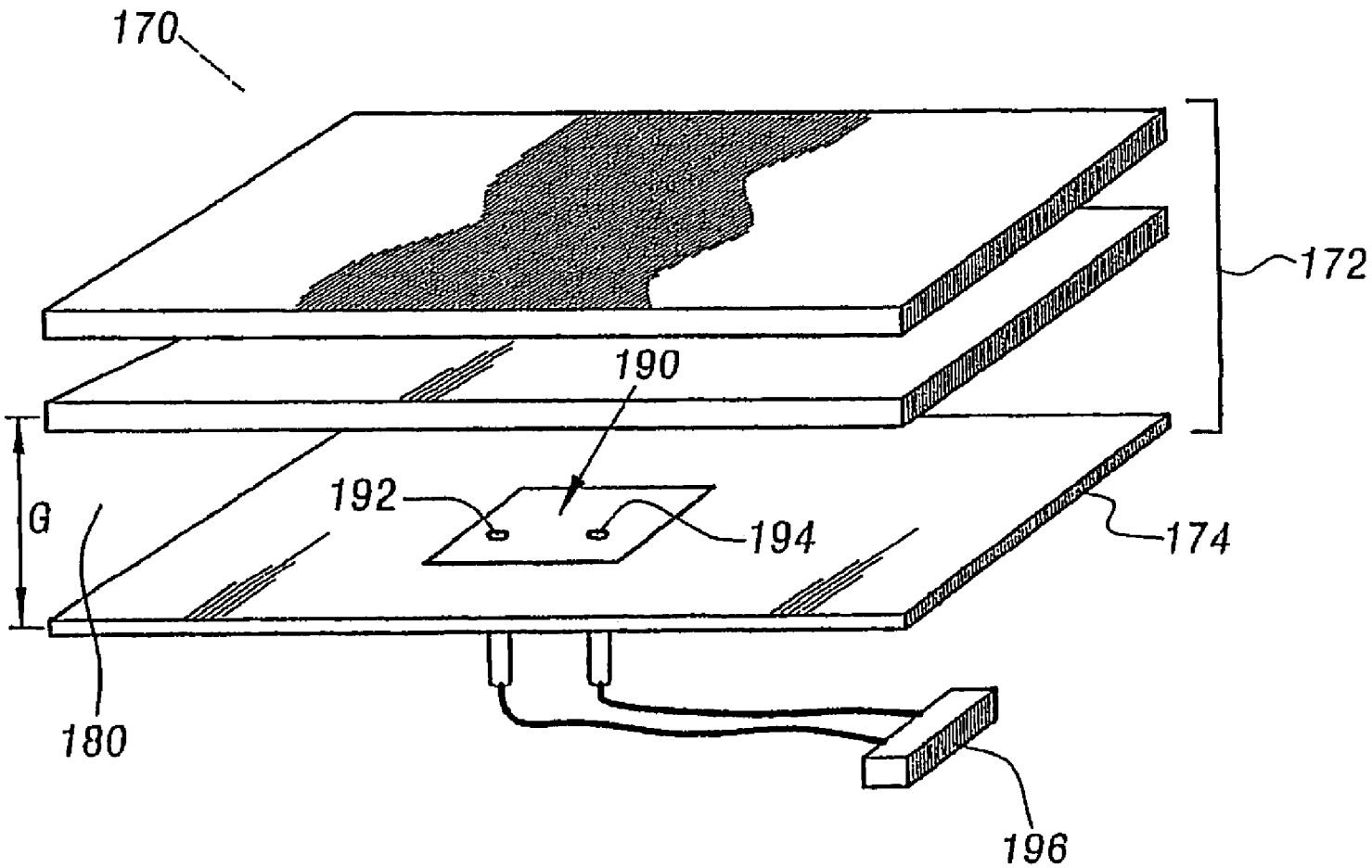
FIG. 4 is an illustration of a second embodiment of a frequency multiband antenna in accordance with the invention.

FIG. 4 represents a second embodiment of a frequency multiband antenna 170 comprising a PBG material 172 associated with an electromagnetic wave reflector metallic plane 174.

In this embodiment, the PBG material is arranged in such a manner as to exhibit several stopbands separated from one another by wide bands where the electromagnetic waves are not absorbed.

Figure 5:
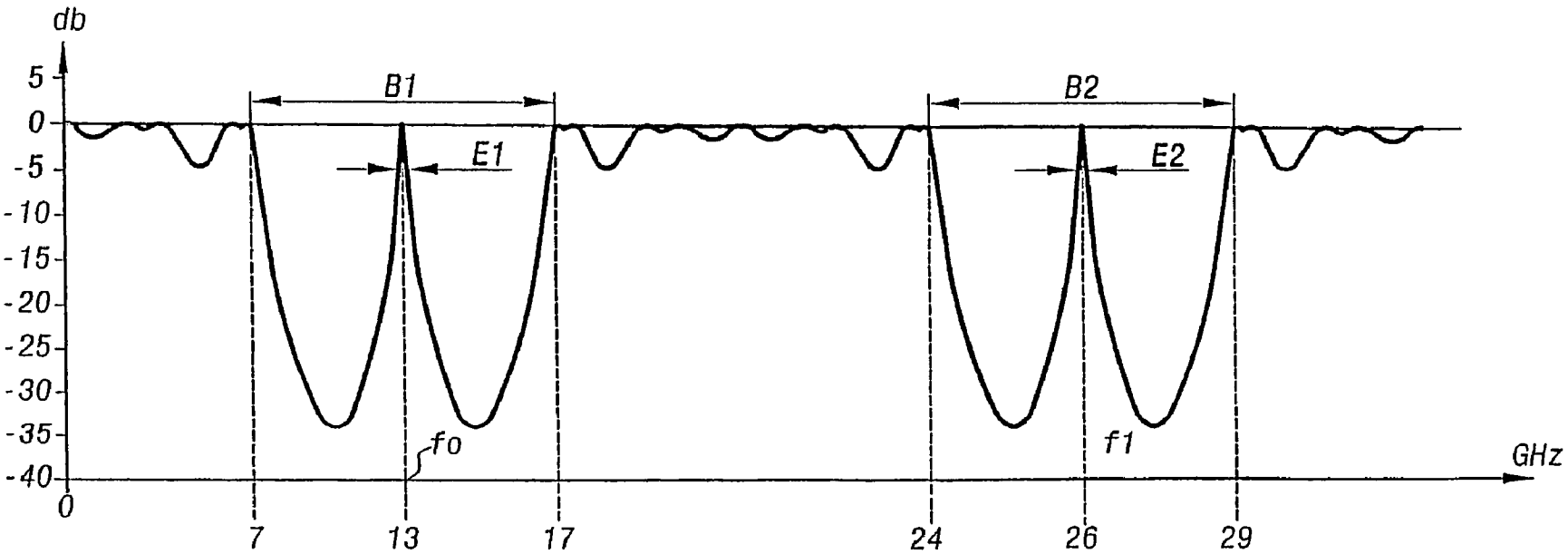
FIG. 5 is a graphic representing the transmission coefficient of the antenna of FIG. 4.

FIG. 5 represents the profile of the transmission coefficient of this antenna 140 and, in particular, two stopbands $B_1$ and $B_2$ of the same PBG material 172. The stopband $B_1$ is centered on a frequency $f_0$ the stopband $B_2$ is centered on an integer multiple of $f_0$, here 2 $f_0$.

PBG materials exhibiting several stopbands are known and the arrangement of this material 172 to create these stopbands will not be described here.

The PBG material 172 comprises, in a similar manner to the PBG material 142, a break of periodicity of its geometrical characteristics forming a resonant parallelepipedal cavity 180 having a constant height G.

The height G is determined here in such a way as to create a narrow passband $E_1$ substantially in the middle of the stopband $B_1$ and a passband $E_2$ substantially placed in the middle of the stopband $B_2$. Here, the passband $E_1$ is centered on the fundamental frequency $f_0$ substantially equal to 13 GHz. The narrow passband $E_2$ is centered on a frequency $f_1$ equal to an integer multiple of the fundamental frequency $f_0$. This frequency $f_1$ is here substantially equal to 26 GHz.

Finally, for example, a single excitation element 190 is placed on the reflector plane 174 inside the cavity 180. This excitation element 190 is able to emit and/or to receive electromagnetic waves at working frequencies $f_{T1}$ and $f_{T2}$. These frequencies $f_{T1}$ and $f_{T2}$ are both able to excite the same resonant mode of the cavity 180, for example here, the resonant mode $TM_0$, so as to exhibit, for each of these frequencies, practically the same radiation pattern. However, these frequencies $f_{T1}$ and $f_{T2}$ lie respectively in the passbands $E_1$ and $E_2$.

In this embodiment, the excitation element 190 is a rectangular patch or plate antenna, equipped with two ports 192, 194 linked to a generator/receiver 196 of electrical signals. The ports 192 and 194 are able to excite two polarizations, preferably two mutually orthogonal polarizations, of the excitation element 190. Here, the ports 192 and 194 are intended to receive and/or emit the signals respectively at the frequencies $f_{T2}$ and $f_{T1}$.

This antenna 170, in a similar manner to the antenna 140, utilizes the fact that one and the same defect creates several narrow passbands centered on integer multiple frequencies of a fundamental frequency. However, in this embodiment, a single excitation element is used to work simultaneously at the two working frequencies $f_{T1}$ and $f_{T2}$. Moreover, in this embodiment, the electromagnetic waves emitted at the frequencies $f_{T1}$ and $f_{T2}$ are polarized in a mutually orthogonal manner so as to limit the interference between these two working frequencies.

The manner of operation of this antenna 170 stems from that described for the antenna 140.

The antenna 170 described here is a multiband antenna, that is to say suitable for working at several different frequencies, but exhibiting, for each working frequency, the same radiation pattern.

As a variant, the excitation elements 160 and 162 of the antenna 140 are replaced with a single excitation element suitable for working simultaneously at the frequencies $f_{T1}$ and $f_{T2}$. This single excitation element is, for example, identical to the excitation element 190. Reciprocally, the excitation element 190 of the antenna 170 is replaced, as a variant, with two distinct and mutually independent excitation elements suitable respectively for working at the frequency $f_{T1}$ and $f_{T2}$. These two excitation elements are, for example, identical to the excitation elements 160 and 162.

The invention claimed is:

1. A frequency multiband antenna comprising:

a Photonic Bandgap (PBG) material suitable for the spatial and frequency-wise filtering of electromagnetic waves, said PBG material exhibiting at least one stopband and forming an exterior surface radiating in emission and/or in reception, at least one defect of periodicity of the PBG material in such a way as to create at least one narrow passband within said at least one stopband of said PBG material, and an excitation device suitable for emitting and/or receiving electromagnetic waves inside said at least one narrow passband created by said at least one defect, wherein:

the excitation device is suitable for working simultaneously at least around a first and a second distinct working frequency;

the first and the second working frequencies are situated inside respectively a first and a second narrow passband, mutually distinct, and the first and the second narrow passbands are created by the same defect of periodicity of the PBG material.

2. The antenna as claimed in claim 1, wherein the defect of periodicity of the PBG material creating the first and the second narrow passbands forms a leaky resonant cavity exhibiting a constant height in a direction orthogonal to said exterior surface, and in that said height is adapted so as to place the first and the second narrow passbands within said at least one stopband of the PBG material.

3. The antenna as claimed in claim 2, wherein the height of the cavity is adapted so as to place the first and the second narrow passbands within one and the same stopband of the PBG material.

4. The antenna as claimed in claim 2, wherein the PBG material exhibits a first and a second mutually spaced disjoint stopband, and the height of the cavity is adapted so as to place the first and the second narrow passbands within respectively the first and the second stopbands of the PBG material.

5. The antenna as claimed in claim 2, wherein the cavity exhibits a family of resonant frequencies formed by a fundamental frequency and its harmonics, the resonant mode of the cavity and the radiation pattern of the antenna being the same for each resonant frequency of the family, and the first and the second working frequencies each correspond, in their respective narrow passband, to a frequency of the same family.

6. The antenna as claimed in claim 2, wherein the cavity exhibits at least two families of resonant frequencies each formed by a fundamental frequency and its harmonics, a resonant mode and a radiation pattern of the antenna being the same for each resonant frequency of one and the same family and different from those of the other families of resonant frequencies, and the first and the second working frequencies each correspond, in their respective narrow passband, to frequencies belonging to different families.

7. The antenna as claimed in claim 2, wherein the leaky resonant cavity is of parallelepipedal shape.

8. The antenna as claimed in claim 1, wherein said first narrow passband is substantially centered on a fundamental frequency, while said second narrow passband is substantially centered on an integer multiple of this fundamental frequency.

9. The antenna as claimed in claim 1, wherein the excitation device is able to emit electromagnetic waves at the first working frequency having a different polarization from the electromagnetic waves emitted at the second working frequency.

10. The antenna as claimed in claim 1, wherein the excitation device comprises at least one same excitation element suitable for emitting and/or for receiving electromagnetic waves simultaneously at the first and at the second working frequencies.

11. The antenna as claimed in claim 1, wherein the excitation device comprises a first and a second excitation element each suitable for emitting and/or for receiving electromagnetic waves, and the first excitation element is suitable for working at the first working frequency, while the second excitation element is suitable for working at the second working frequency.

12. The antenna as claimed in claim 11, wherein each of the excitation elements is able to generate, on said exterior surface, respectively a first and a second mutually disjoint radiating spot, each of these radiating spots representing the origin of an electromagnetic wave beam radiated in emission and/or in reception by the antenna.

* * * * *